US011192371B2

(12) United States Patent
Owaki et al.

(10) Patent No.: US 11,192,371 B2
(45) Date of Patent: Dec. 7, 2021

(54) LIQUID EJECTING UNIT AND LIQUID EJECTING APPARATUS

(71) Applicant: SEIKO EPSON CORPORATION, Tokyo (JP)

(72) Inventors: Hiroshige Owaki, Okaya (JP); Shigeki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/804,816

(22) Filed: Feb. 28, 2020

(65) Prior Publication Data

US 2020/0276817 A1 Sep. 3, 2020

(30) Foreign Application Priority Data

Mar. 1, 2019 (JP) ..... JP2019-037275

(51) Int. Cl.
*B41J 2/14* (2006.01)

(52) U.S. Cl.
CPC ..... *B41J 2/14427* (2013.01); *B41J 2/1429* (2013.01); *B41J 2/1433* (2013.01); *B41J 2002/14467* (2013.01)

(58) Field of Classification Search
CPC .... B41J 2/14427; B41J 2/1433; B41J 2/1429; B41J 2002/14467; B41J 2/175; B41J 2/17509; B41J 2/17596; B41J 2/18
See application file for complete search history.

(56) References Cited

U.S. PATENT DOCUMENTS

| | | | | |
|---|---|---|---|---|
| 6,739,706 | B2 * | 5/2004 | Barinaga | B41J 2/17509 347/85 |
| 9,289,982 | B2 * | 3/2016 | Taff | B41J 2/04581 |
| 2011/0316935 | A1 | 12/2011 | Sato et al. | |
| 2017/0225459 | A1 | 8/2017 | Yokozawa et al. | |

FOREIGN PATENT DOCUMENTS

| | | |
|---|---|---|
| JP | 2008-087436 | 4/2008 |
| JP | 2010-143109 | 7/2010 |
| JP | 2012-011560 | 1/2012 |
| JP | 2016-007783 | 1/2016 |
| JP | 2016-159618 | 9/2016 |

* cited by examiner

*Primary Examiner* — Lamson D Nguyen
(74) *Attorney, Agent, or Firm* — Workman Nydegger

(57) ABSTRACT

A liquid ejecting unit including a flow path structure into which a liquid flow from a liquid reservoir that temporarily stores the liquid, a liquid ejecting head coupled to the flow path structure and including a nozzle for ejecting the liquid supplied from the flow path structure, and a heating portion heating the liquid inside the flow path structure.

16 Claims, 10 Drawing Sheets

LIQUID EJECTING UNIT AND LIQUID EJECTING APPARATUS

The present application is based on, and claims priority from JP Application Serial Number 2019-037275, filed Mar. 1, 2019, the disclosure of which is hereby incorporated by reference herein in its entirety.

BACKGROUND

1. Technical Field

The present disclosure relates to a liquid ejecting unit and a liquid ejecting apparatus.

2. Related Art

Hitherto, a technique for ejecting a liquid, such as ink, from nozzles has been proposed. For example, JP-A-2016-159618 discloses a recording head including recording element substrates in which ejection ports that eject ink are formed, and heating elements that heat the ink inside the ejection port. The heating elements are provided in the recording element substrates.

However, in the technique of JP-A-2016-159618, since the volume of the ink inside each recording element substrate is small, it is difficult to appropriately maintain the temperature of the liquid ejected from the ejection ports. Specifically, there are cases in which the ink is excessively heated or cases in which the ink is not heated to the appropriate temperature.

SUMMARY

In order to overcome the above issue, a liquid ejecting unit according to a desirable aspect of the present disclosure includes a flow path structure into which a liquid from a liquid reservoir that temporarily stores the liquid flows, a liquid ejecting head that is coupled to the flow path structure and that ejects, through a nozzle, the liquid supplied from the flow path structure, and a heating portion that heats the liquid inside the flow path structure.

A liquid ejecting apparatus according to a desirable aspect of the present disclosure includes a flow path structure into which a liquid from a liquid reservoir that temporarily stores the liquid flows, a liquid ejecting head that is coupled to the flow path structure and that ejects, through a nozzle, the liquid supplied from the flow path structure, and a heating portion that heats the liquid inside the flow path structure.

DESCRIPTION OF EXEMPLARY EMBODIMENTS

First Exemplary Embodiment

Figure 1:
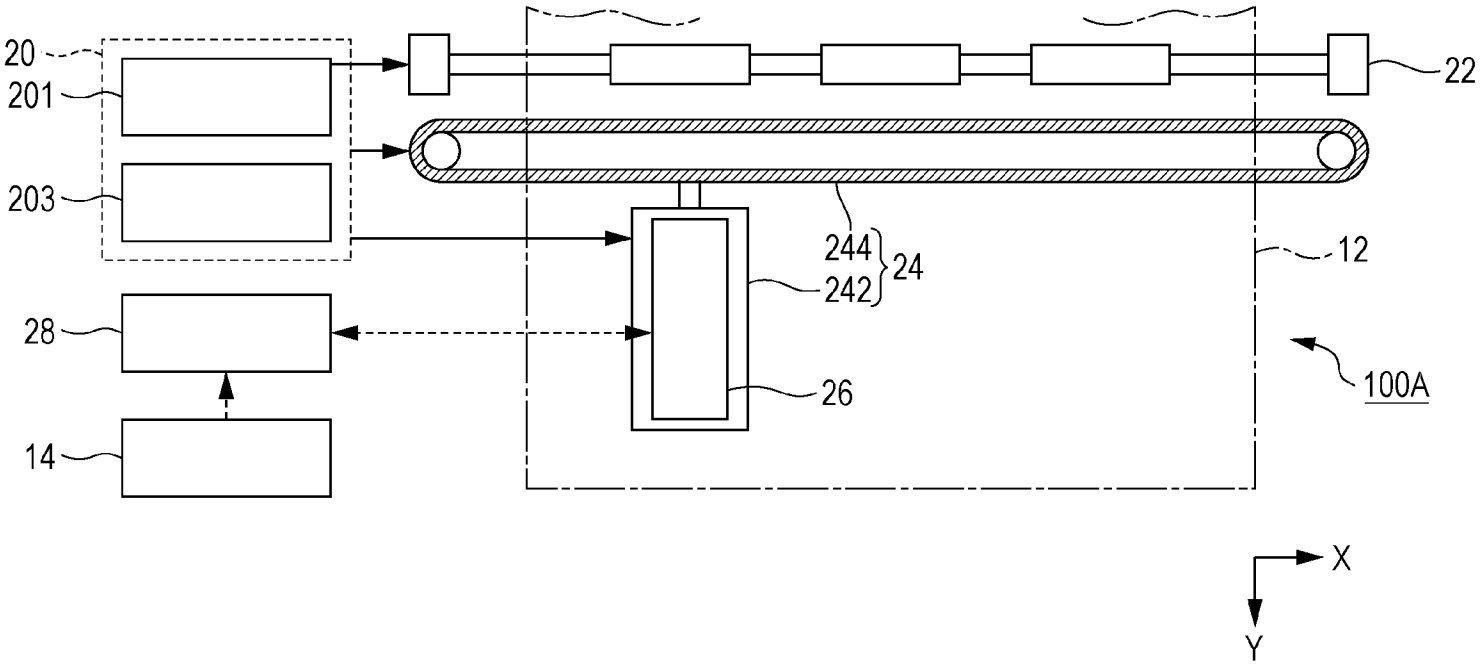
FIG. 1 is a block diagram illustrating, as an example, a configuration of a liquid ejecting apparatus according to a first exemplary embodiment.

FIG. 1 is a block diagram illustrating an example of a liquid ejecting apparatus 100A according to a first exemplary embodiment. The liquid ejecting apparatus 100A of the first exemplary embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is provided in the liquid ejecting apparatus 100A. For example, a cartridge configured to detach from the liquid ejecting apparatus 100A, a bag-shaped ink pack formed of flexible film, or an ink tank into which ink can be refilled is used as the liquid container 14.

As illustrated as an example in FIG. 1, the liquid ejecting apparatus 100A includes a control unit 20, a transport mechanism 22, a moving mechanism 24, a liquid ejecting portion 26, and a flow path mechanism 28. The control unit 20 includes a processing circuit such as a central processing unit (CPU) or a field programmable gate array (FPGA) and a memory circuit such as a semiconductor memory, and controls each element of the liquid ejecting apparatus 100A in an integrated manner. Specifically, the control unit 20 functions as an ejection control portion 201 and a heating control portion 203. The transport mechanism 22 transports the medium 12 along a Y-axis under the control of the ejection control portion 201.

The moving mechanism 24 reciprocates the liquid ejecting portion 26 along an X-axis under the control of the ejection control portion 201. The X-axis intersects the Y-axis along which the medium 12 is transported. The moving mechanism 24 of the first exemplary embodiment includes a substantially box-shaped transport body 242 that houses the liquid ejecting portion 26, and a transport belt 244 to which the transport body 242 is fixed. Note that a configuration in which a plurality of liquid ejecting portions 26 are mounted in the transport body 242 or a configuration in which the liquid container 14 or the flow path mechanism 28 is mounted in the transport body 242 together with the liquid ejecting portion 26 can be adopted.

The liquid ejecting portion 26 ejects the ink supplied from the liquid container 14 onto the medium 12 through a plurality of nozzles under the control of the ejection control portion 201. Concurrently with the transportation of the medium 12 performed with the transport mechanism 22 and the repetitive reciprocation of the transport body 242, the liquid ejecting portion 26 ejects ink onto the medium 12 to form an image on a surface of the medium 12. The flow path mechanism 28 is a mechanism that supplies ink to the liquid ejecting portion 26 and that stores the ink discharged from the liquid ejecting portion 26.

Figure 2:
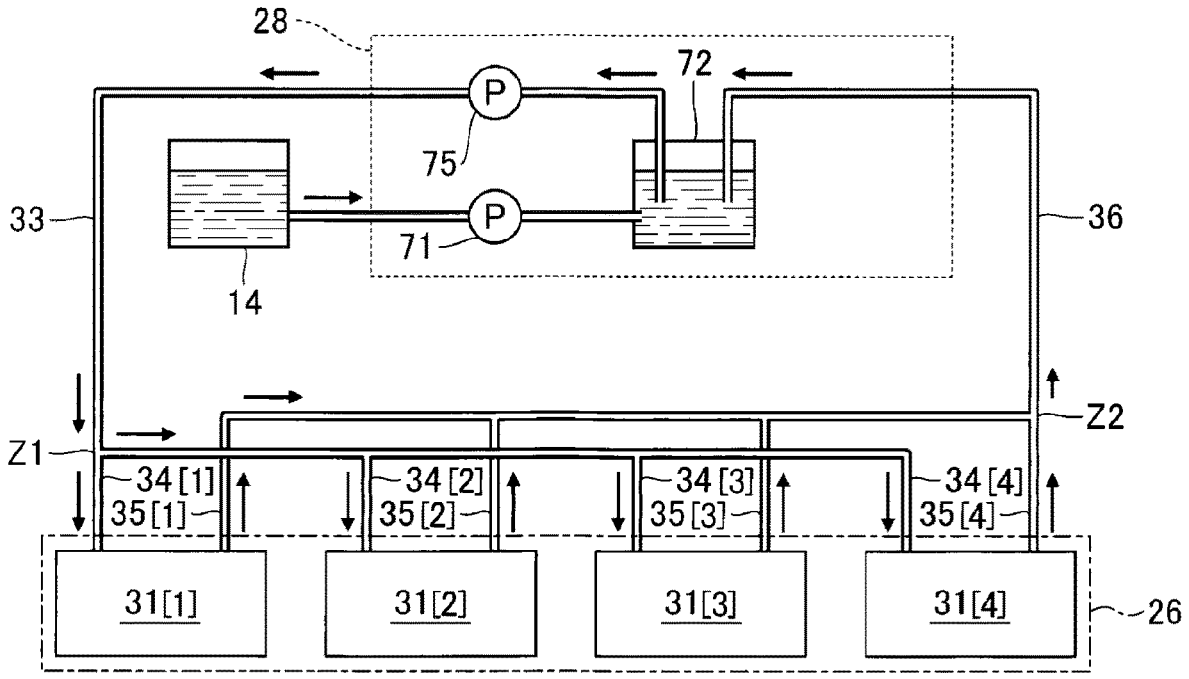
FIG. 2 is a schematic diagram illustrating, as an example, configurations of a liquid ejecting portion and a flow path mechanism.

FIG. 2 is a schematic diagram illustrating an example of a specific configuration of the liquid ejecting portion 26 and the flow path mechanism 28. As illustrated as an example in FIG. 2, the liquid ejecting portion 26 includes four liquid ejecting units 31[1] to 31[4]. Each liquid ejecting unit 31[*m*] ejects ink under the control of the ejection control portion 201 (m=1 to 4). Note that the number of liquid ejecting units 31[*m*] mounted in the liquid ejecting portion 26 is optional.

As illustrated as an example in FIG. 2, the liquid ejecting portion 26 and the flow path mechanism 28 are connected to each other through a plurality of flow paths. Specifically, a first common flow path 33, four first individual flow paths 34[1] to 34[4], four second individual flow paths 35[1] to 35[4], and a second common flow path 36 connect the liquid ejecting portion 26 and the flow path mechanism 28 to each other. The first common flow path 33 and the second common flow path 36 are flow paths common to the four liquid ejecting units 31[1] to 31[4]. The first individual flow path 34[*m*] and the second individual flow path 35[*m*] are flow paths formed individually for each liquid ejecting unit 31[*m*]. The first common flow path 33 and the four first individual flow paths 34[1] to 34[4] are flow paths that supply the ink inside the flow path mechanism 28 to the four liquid ejecting units 31[*m*] in a parallel manner. The four second individual flow paths 35[1] to 35[4] and the second common flow path 36 are flow paths that supply the ink discharged from the four liquid ejecting units 31[1] to 31[4] to the flow path mechanism 28.

The first common flow path 33 is a flow path that communicates the flow path mechanism 28 and each first individual flow path 34[*m*] to each other. The first individual flow path 34[*m*] is a flow path that communicates the first common flow path 33 and the liquid ejecting unit 31[*m*] to each other. The flow path that supplies the ink from the flow path mechanism 28 to the liquid ejecting unit 31[*m*] is, from the first common flow path 33, branched at a branching point Z1 in FIG. 2 into four systems, namely, the first individual flow paths 34[1] to 34[4]. In other words, the ink supplied from the flow path mechanism 28 is distributed to the four liquid ejecting units 31[1] to 31[4]. The first individual flow path 34[*m*] is a flow path from the branching point Z1 to the liquid ejecting unit 31[*m*].

The second common flow path 36 in FIG. 2 is a flow path that communicates the second individual flow path 35[*m*] and the flow path mechanism 28 to each other. The second individual flow path 35[*m*] is a flow path that communicates the second common flow path 36 and the liquid ejecting unit 31[*m*] to each other. The ink discharged from the four liquid ejecting units 31[1] to 31[4] to the second individual flow paths 35[1] to 35[4] is merged at a merging point Z2 in FIG. 2 and flows into the second common flow path 36.

As illustrated as an example in FIG. 2, the flow path mechanism 28 includes a first pump 71, a liquid reservoir 72, and a second pump 75. The first pump 71 is a pump that supplies the ink stored in the liquid container 14 to the liquid reservoir 72.

The liquid reservoir 72 is a container that temporarily stores the ink supplied from the liquid container 14. The liquid container 14 functions as a main tank, and the liquid reservoir 72 functions as a sub tank that temporarily stores the ink in the liquid container 14. Not only the ink stored in the liquid container 14 is supplied to the liquid reservoir 72 through the first pump 71, the ink discharged from the liquid ejecting portion 26 is supplied to the liquid reservoir 72 through the second common flow path 36.

The second pump 75 sends out the ink stored in the liquid reservoir 72 at a predetermined pressure. The ink flowing out through the second pump 75 is supplied to the liquid ejecting portion 26 through the first common flow path 33.

As understood from the above description, the ink supplied from the flow path mechanism 28 to the liquid ejecting portion 26 circulates through the following path: the first common flow path 33→the first individual flow path 34[*m*]→the liquid ejecting unit 31[*m*]→the second individual flow path 35[*m*]→the second common flow path 36→the liquid reservoir 72→the second pump 75. In other words, the ink circulates between the liquid reservoir 72 and the liquid ejecting unit 31[*m*] through the first common flow path 33, the first individual flow path 34[*m*], the second individual flow path 35 [m], and the second common flow path 36.

Figure 3:
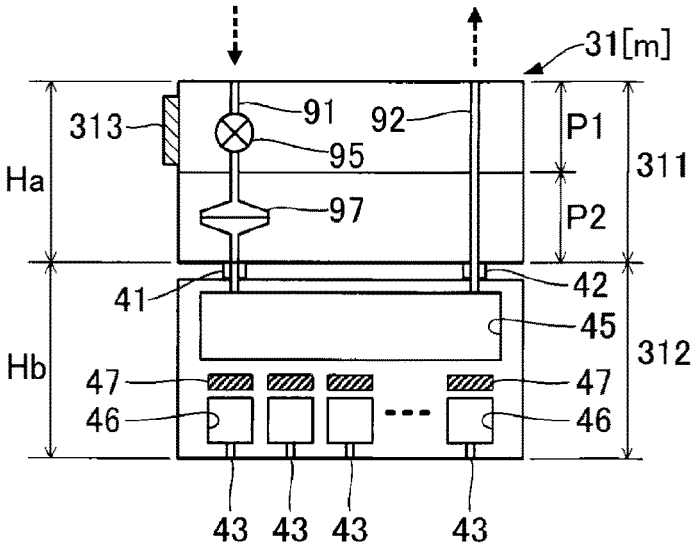
FIG. 3 is a schematic diagram illustrating, as an example, a configuration of a liquid ejecting unit.

Hereinafter, a specific configuration of the liquid ejecting unit 31[*m*] will be described. FIG. 3 is a diagram illustrating an example of a configuration of the liquid ejecting unit 31[*m*]. As illustrated as an example in FIG. 3, the liquid ejecting unit 31[*m*] includes a flow path structure 311 and a liquid ejecting head 312 coupled to the flow path structure 311. Note that the flow path structure 311 is detachable from the liquid ejecting head 312 and is integrally coupled to the liquid ejecting head 312. Note that a height Ha of the flow path structure 311 and a height Hb of the liquid ejecting head 312 are substantially the same. The flow path structure 311 is a structure that supplies ink to the liquid ejecting head 312, and flow paths in communication with the liquid ejecting head 312 are formed therein. Specifically, a supply flow path 91 and a discharge flow path 92 are formed in the flow path structure 311. The supply flow path 91 is a flow path communicating the first individual flow path 34[*m*] and the liquid ejecting unit 31[*m*] to each other. The ink supplied from the first individual flow path 34[*m*] passes through the supply flow path 91 and flows into the liquid ejecting head 312. On the other hand, the discharge flow path 92 is a flow path that communicates the liquid ejecting unit 31[*m*] and the second individual flow path 35[*m*] to each other. The ink discharged from the liquid ejecting head 312 passes through the discharge flow path 92 and flows into the second individual flow path 35[*m*].

As illustrated as an example in FIG. 3, the flow path structure 311 includes a first portion P1 and a second portion P2. The supply flow path 91 and the discharge flow path 92 are formed across the first portion P1 and the second portion P2. A valve mechanism 95 that controls the pressure of the ink supplied to the liquid ejecting head 312 is formed in a portion of the supply flow path 91 formed in the first portion P1. In other words, the first portion P1 includes the valve mechanism 95. A heating portion 313 that heats the ink inside the valve mechanism 95 is provided in the first portion P1. The heating portion 313 includes, for example, a heat generating mechanism that maintains the temperature of the ink inside the valve mechanism 95 at a desired temperature under the control of the heating control portion 203 in FIG. 1. Note that specific configurations of the valve mechanism 95 and the heating portion 313 will be described later.

For example, a sensor that detects the temperature of the ink inside the valve mechanism 95 is provided in the flow path structure 311. The heating control portion 203 in FIG. 1 controls the heating performed by the heating portion 313 in accordance with the temperature detected by the sensor. For example, when the detected temperature is below a predetermined threshold value, the heating control portion 203 activates the heating performed by the heating portion 313, and when the detected temperature is above a predetermined threshold value, stops the heating performed by the heating portion 313. Note that the heating control portion 203 may control the heating portion 313 in accordance with the ejecting operation of the liquid ejecting head 312. For example, the heating control portion 203 controls the heating portion 313 in accordance with the intervals of the ejecting operation of the liquid ejecting head 312 or in accordance with the amount of ink ejected by the ejecting operation of the liquid ejecting head 312.

As illustrated as an example in FIG. 3, a filter portion 97 is formed in a portion of the supply flow path 91 in which the second portion P2 is formed. In other words, the second portion P2 includes the filter portion 97. The filter portion 97 is a mechanism that collects air bubbles and foreign matters mixed in the ink. Note that a specific configuration of the filter portion 97 will be described later. The ink supplied from the first individual flow path 34[*m*] passes through the valve mechanism 95 and the filter portion 97 in that order and flows into the liquid ejecting head 312. Note that the positional relationship between the valve mechanism 95 and the filter portion 97 may be reversed.

The liquid ejecting head 312 ejects the ink supplied from the flow path structure 311. As illustrated as an example in FIG. 3, a supply port 41, a discharge port 42, a common liquid chamber 45, a plurality of pressure chambers 46, and a plurality of drive elements 47 are provided in the liquid ejecting head 312. The common liquid chamber 45 is a space that is common across the plurality of nozzles 43. The ink supplied from the flow path structure 311 is stored in the common liquid chamber 45. The ink flowing in through the supply flow path 91 is supplied into the common liquid chamber 45 through the supply port 41. In other words, the supply flow path 91 communicates the supply port 41 and the first individual flow path 34[*m*] to each other.

The pressure chamber 46 and the drive element 47 are formed for each nozzle 43. Each pressure chamber 46 is a space in communication with the corresponding nozzle 43. The ink supplied from the common liquid chamber 45 is filled in each of the plurality of pressure chambers 46. Each drive element 47 changes a pressure inside the corresponding pressure chamber 46. A piezoelectric element that changes the volume of the pressure chamber 46 by deforming a wall surface of the pressure chamber 46, or a heating element that generates an air bubble inside the pressure chamber 46 by heating the ink inside the pressure chamber 46 may be suitably used as the drive element 47. The ink inside the pressure chamber 46 is ejected through the nozzle 43 by having the drive elements 47 change the pressure inside the pressure chamber 46. In other words, the pressure chambers 46 function as elements that eject, through the nozzles 43, the ink supplied from the common liquid chamber 45. In the ink supplied to the common liquid chamber 45 through the supply port 41, the ink that has not been ejected through the nozzles 43 is discharged through the discharge port 42. The ink discharged from the discharge port 42 flows through the discharge flow path 92. In other words, the discharge flow path 92 communicates the discharge port 42 and the second individual flow path 35[*m*] to each other. The flow path mechanism 28 functions as a circulation mechanism that recirculates the ink that has passed through the common liquid chamber 45 or the pressure chambers 46 to the common liquid chamber 45.

Figure 4:
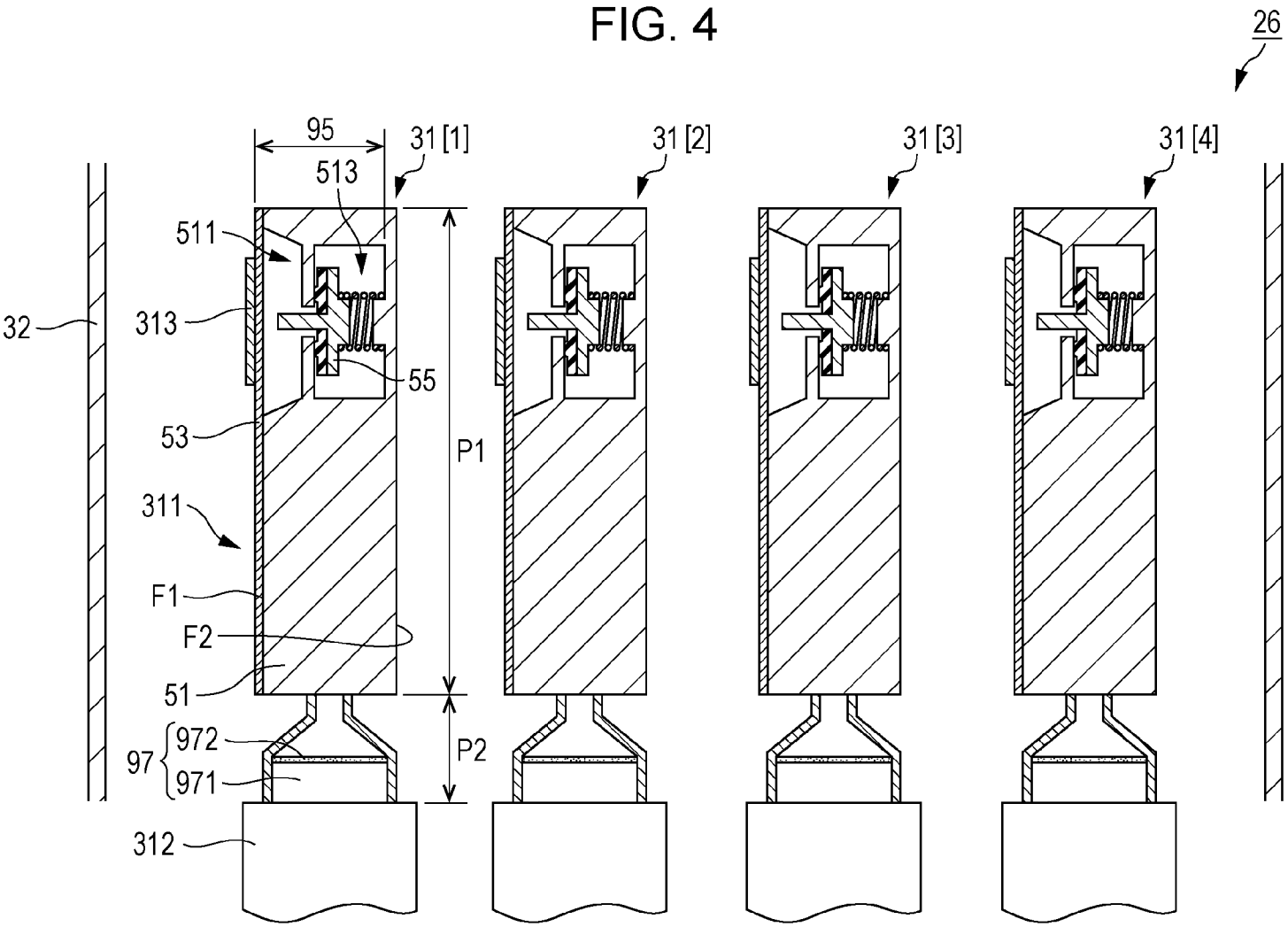
FIG. 4 is a cross-sectional view of the liquid ejecting portion.

FIG. 4 is a cross-sectional view of the liquid ejecting portion 26. As illustrated as an example in FIG. 4, the flow path structure 311 of each liquid ejecting unit 31[*m*] is housed in a housing body 32. The housing body 32 is a hollow structure formed in a substantially box shape. The flow path structure 311 is housed inside the housing body 32. As described above, the flow path structure 311 includes the first portion P1 and the second portion P2. As illustrated as an example in FIG. 4, the first portion P1 of the flow path structure 311 includes base portions 51, movable films 53, and valve bodies 55. The base portion 51 is a flat plate-shaped member and includes a first face F1 and a second face F2 on the opposite side of the first face F1. A first liquid chamber 511 and a second liquid chamber 513 are formed in the base portion 51. The first liquid chamber 511 is an example of a "heating liquid chamber".

Figure 5:
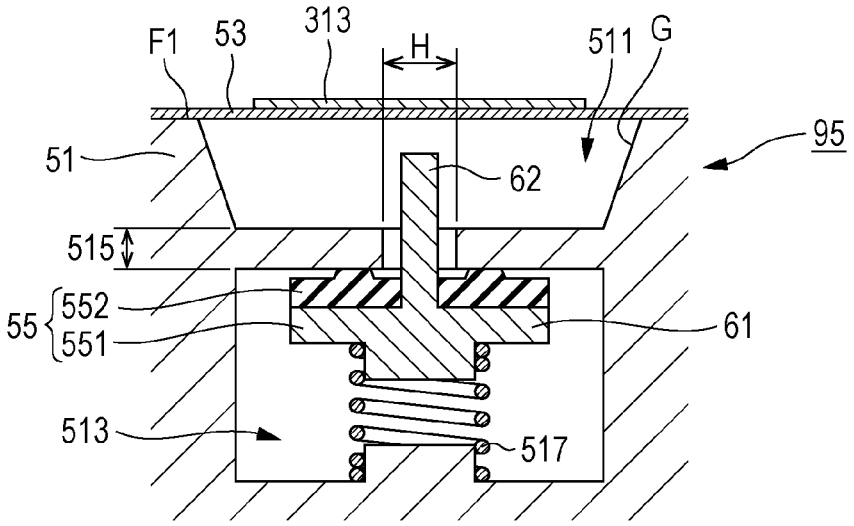
FIG. 5 is a cross-sectional view of a valve mechanism.

FIG. 5 is an enlarged cross-sectional view of a vicinity of the first liquid chamber 511. As illustrated in FIGS. 4 and 5 as an example, the first liquid chamber 511 is a space formed by a recessed portion G formed in the first face F1 in the base portion 51, and the movable film 53 provided on the first face F1 of the base portion 51 so as to close the recessed portion G. In other words, the movable film 53 constitutes a wall surface of the first liquid chamber 511. A volume of the first liquid chamber 511 is larger than a volume of the common liquid chamber 45. The second liquid chamber 513 is a space in communication with the first liquid chamber 511 through the valve body 55. The valve body 55 is provided in the second liquid chamber 513. The ink inside the liquid reservoir 72 of the flow path mechanism 28 flows into the second liquid chamber 513 through the first common flow path 33 and the first individual flow path 34[*m*].

As illustrated as an example in FIG. 5, a valve seat 515 is formed between the second liquid chamber 513 and the first liquid chamber 511 in the base portion 51. In other words, the valve seat 515 functions as a partition wall that divides the second liquid chamber 513 and the first liquid chamber 511 from each other. The valve seat 515 and the movable film 53 oppose each other. Opening and closing between the second liquid chamber 513 and the first liquid chamber 511 are switched by having the valve body 55 move, with respect to the valve seat 515, in a direction away from the first face F1 and in a direction approaching the first face F1. A through hole H that is a perfect circle hole is formed at the middle of the valve seat 515. The second liquid chamber 513 located upstream of the valve seat 515 and the first liquid chamber 511 located downstream of the valve seat 515 are in communication with each other through the through hole H of the valve seat 515. Note that a pressure plate may be provided on a surface of the movable film 53 on the valve seat 515 side.

A spring 517 is provided inside the second liquid chamber 513. The spring 517 is provided between the wall surface of the second liquid chamber 513 and the valve body 55 and biases the valve body 55 towards the valve seat 515 side. As illustrated as an example in FIG. 5, the valve body 55 includes a support 551 and an elastic body 552. The support 551 is a structure that supports the elastic body 552.

The support 551 includes a base portion 61 and a valve stem 62 that are formed integrally with each other. The base portion 61 is a flat plate-shaped portion formed in a circular shape having an outer diameter that is larger than an inner diameter of the through hole H. The valve stem 62 is a straight rod-shaped portion that protrudes from a surface of the base portion 61 towards the movable film 53. The diameter of the valve stem 62 is smaller than the inner diameter of the through hole H. As illustrated in FIG. 5 as an example, the valve stem 62 is inserted through the through hole H and penetrates through the valve seat 515. In other words, a distal end of the valve stem 62 protrudes from the valve seat 515 towards the movable film 53 and opposes the movable film 53. The valve stem 62 and an internal circumferential surface of the through hole H oppose each other with a gap in between.

The elastic body 552 is a structure formed of an elastic material. The elastic body 552 of the first exemplary embodiment is formed in an annular shape in plan view and is fixed to the base portion 61 while the valve stem 62 penetrates therethrough. The elastic body 552 is located between the base portion 61 of the support 551 and the valve seat 515 and functions as a seal that closes the through hole H by coming in contact with the valve seat 515.

The ink in the first individual flow path 34[*m*] is supplied to the first liquid chamber 511 through the second liquid chamber 513. The ink inside the first liquid chamber 511 is supplied to the second portion P2 in accordance with the pressure inside the first liquid chamber 511. Specifically, in a normal state in which the pressure inside the first liquid chamber 511 is maintained within a predetermined range, the spring 517 biases the valve body 55 so that the elastic body is in contact with a surface of the valve seat 515; accordingly, as illustrated as an example in FIG. 5, a closed state in which the valve body 55 closes the through hole H of the valve seat 515 is maintained. In other words, the second liquid chamber 513 and the first liquid chamber 511 are shut off from each other. On the other hand, when the pressure inside the first liquid chamber 511 decreases due to an ejection of the ink with the liquid ejecting portion 26 or due to suction from an external portion, for example, the movable film 53 is displaced towards the valve seat 515 side and the movable film 53 countering the biasing of the spring 517 pushes the valve stem 62 of the valve body 55. When the valve body 55 pushed by the movable film 53 moves in a direction away from the first face F1, the closed state is transitioned to an open state in which the elastic body 552 is separated from the valve seat 515. In other words, the movable film 53 is moved in association with the change in the pressure of the first liquid chamber 511. In the open state, the through hole H of the valve seat 515 is open and the second liquid chamber 513 and the first liquid chamber 511 are in communication with each other through the through hole H. The ink inside the first liquid chamber 511 is supplied to the liquid ejecting head 312 through the second portion P2. As understood from the above description, the valve body 55, the valve seat 515, the spring 517, and the movable film 53 function as the valve mechanism 95 that supplies a liquid to the liquid ejecting head 312 in accordance with the pressure in the first liquid chamber 511.

As illustrated as an example in FIGS. 4 and 5, the heating portion 313 is provided on the movable film 53 and on a surface of the movable film 53 on a side opposite the first liquid chamber 511. In other words, among the surfaces of the flow path structure 311, the heating portion 313 is provided in an area near the first liquid chamber 511. The heating portion 313 of the first exemplary embodiment is a thin film-shaped film heater. Note that the shape of the heating portion 313 is not limited to the thin film shape. The ink inside the first liquid chamber 511 is heated with the heating portion 313. The ink that has been heated by the heating portion 313 is supplied to the liquid ejecting head 312.

As illustrated as an example in FIG. 4, the second portion P2 is coupled to the first portion P1. The ink supplied to the liquid ejecting head 312 from the first liquid chamber 511 passes through the filter portion 97. Specifically, the filter portion 97 includes a filter chamber 971 and a filter 972. The filter chamber 971 is a space into which the ink in the first portion P1 flows. The filter portion 97 is provided inside the filter chamber 971 and collects air bubbles or foreign matters mixed in the ink that has passed through the first portion P1. The ink that has passed through the filter portion 97 is supplied to the liquid ejecting head 312. In other words, the liquid ejecting head 312 ejects the ink, which is supplied from the first liquid chambers 511, through the nozzles 43.

Minute flow paths are formed in the liquid ejecting head 312. Specifically, flow paths each having a flow path diameter that is smaller than the flow path structure 311 are formed in the liquid ejecting head 312. For example, in a configuration (hereinafter, referred to as a "comparative example") in which the heating portion 313 is provided in the liquid ejecting head 312, since the flow path diameters of the flow paths inside the liquid ejecting head 312 are small, thermoresponsiveness of the ink inside the flow paths to heat becomes high. Accordingly, it will be difficult to perform heating control of maintaining the temperature of the ink in an appropriate manner. When the temperature of the ink cannot be maintained at the desired temperature, the ink cannot be maintained to have the desired viscosity and a problem such as an error in the ejection characteristic occur. The ejection characteristic is, for example, the ejecting amount, the ejecting direction, or the ejecting speed. Conversely, in the first exemplary embodiment, the heating portion 313 is provided on the flow path structure 311 that supplies the ink to the liquid ejecting head 312. Furthermore, the ink inside the first liquid chamber 511 formed in the flow path structure 311 is heated by the heating portion 313. Since a flow path having a flow path diameter that is larger than the liquid ejecting head 312 is formed in the flow path structure 311, the thermoresponsiveness of the ink inside the flow path structure 311 is lower than that of the ink inside the liquid ejecting head 312. Accordingly, the temperature of the ink ejected from the liquid ejecting head 312 can be maintained in an appropriate manner. As understood from the above description, according to the configuration of the first exemplary embodiment, the ink is maintained at the desired viscosity; accordingly, occurrences of errors in the ejection characteristics can be reduced.

In the first exemplary embodiment, since the heating portion 313 does not have to be provided in the liquid ejecting head 312, compared with the comparative example, a size reduction of the liquid ejecting head 312 can be achieved. Since the heating portion 313 of the first exemplary embodiment has a thin film shape, a size reduction of the liquid ejecting unit can be achieved.

Since the ink temporarily stagnates inside the valve mechanism 95, there is an advantage in the configuration of the first exemplary embodiment, in which the heating portion 313 is provided in the first portion P1 that includes the valve mechanism 95, in that the temperature of the ink can be controlled easily in the valve mechanism 95. Furthermore, since, on the movable film 53, the heating portion 313 is provided on the surface on the side opposite the first liquid chamber 511, the ink inside the first liquid chamber 511 can be easily controlled through the thin film-shaped movable film 53. Since the ink inside the first liquid chamber 511 that has a volume larger than that of the common liquid chamber of the liquid ejecting head is heated, an advantages effect in that the temperature of the ink ejected from the liquid ejecting head 312 can be maintained appropriately is prominent.

Second Exemplary Embodiment

A description of a second exemplary embodiment will be given. In the following examples, elements having functions similar to those of the first exemplary embodiment will be denoted by applying the reference numerals used in the description of the first exemplary embodiment, and detailed description of the elements will be omitted appropriately.

Figure 6:
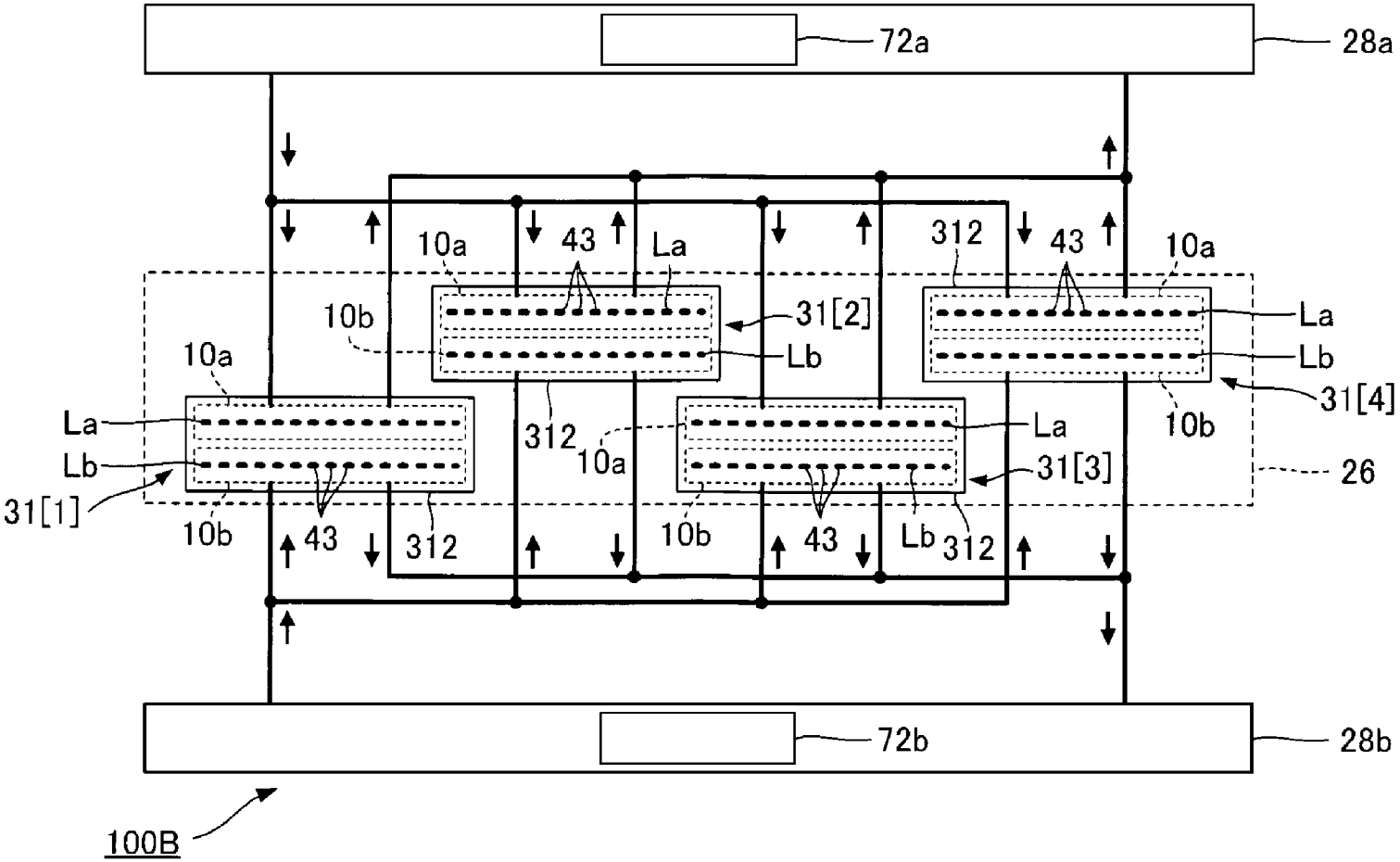
FIG. 6 is a schematic diagram illustrating, as an example, configurations of a liquid ejecting portion and a flow path mechanism according to a second exemplary embodiment.

FIG. 6 is a schematic diagram illustrating a configuration of a liquid ejecting apparatus 100B according to a second exemplary embodiment. As illustrated as an example in FIG. 6, the liquid ejecting apparatus 100B of the second exemplary embodiment includes the liquid ejecting portion 26, a first flow path mechanism 28*a*, and a second flow path mechanism 28*b*.

The liquid ejecting portion 26 includes four liquid ejecting units 31[1] to 31[4]. The liquid ejecting unit 31[*m*] includes the flow path structure 311 and the liquid ejecting head 312. In FIG. 6, for convenience sake, an illustration of the flow path structure 311 is omitted. Note that similar to the first exemplary embodiment, ink is supplied from the flow path structure 311 to the liquid ejecting head 312. As illustrated as an example in FIG. 6, each liquid ejecting head 312 includes a first ejecting portion 10*a* and a second ejecting portion 10*b*. An array (hereinafter, referred to as a "a first line") La of a plurality of nozzles 43 are formed in the first ejecting portion 10*a* and an array (hereinafter, referred to as a "second line") Lb of a plurality of nozzles 43 are formed in the second ejecting portion 10*b*. The first line La and the second line Lb are parallelly arranged with a space in between each other. The first ejecting portion 10*a* ejects ink of a first color through the nozzles 43 of the first line La, and the second ejecting portion 10*b* ejects ink of a second color through the nozzles 43 of the second line Lb. The first color and the second color are different colors.

The first flow path mechanism 28*a* and the second flow path mechanism 28*b* are configured in a manner similar to that of the flow path mechanism 28 of the first exemplary embodiment. The first flow path mechanism 28*a* circulates the ink of the first color to the first ejecting portion 10*a* of each of the four liquid ejecting units 31[1] to 31[4]. Specifically, the first flow path mechanism 28*a* supplies the ink stored in a liquid reservoir 72*a* to the first ejecting portions 10*a* and stores the ink discharged from the first ejecting portions 10*a* in the liquid reservoir 72*a*. In a similar manner, the second flow path mechanism 28*b* circulates the ink of the second color to the second ejecting portion 10*b* of each of the four liquid ejecting units 31[1] to 31[4]. Specifically, the second flow path mechanism 28*b* supplies the ink stored in a liquid reservoir 72*b* to the second ejecting portions 10*b* and stores the ink discharged from the second ejecting portions 10*b* in the liquid reservoir 72*b*. Note that in actuality, the ink in the first flow path mechanism 28*a* and the ink in the second flow path mechanism 28*b* are supplied to each liquid ejecting head 312 through the corresponding flow path structure 311.

As understood from the above description, in the second exemplary embodiment, the flow path that circulates the ink of the first color to the four first ejecting portions 10*a* in the liquid ejecting portion 26, and the flow path that circulates the ink of the second color to the four second ejecting portions 10*b* in the liquid ejecting portion 26 are formed individually. Note that the number of liquid ejecting units 31[*m*] is optional.

Figure 7:
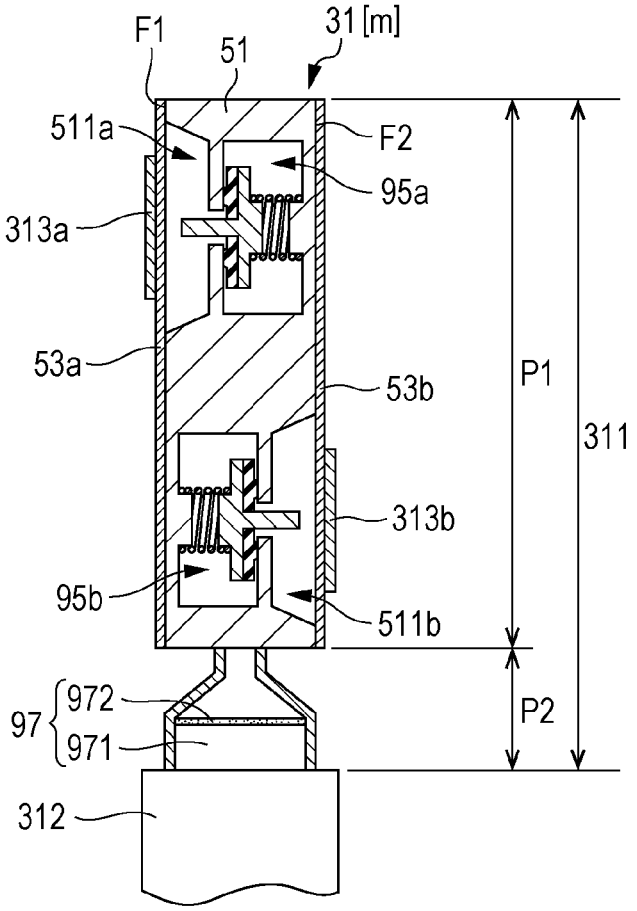
FIG. 7 is a cross-sectional view of a flow path structure according to the second exemplary embodiment.

FIG. 7 is a cross-sectional view of the liquid ejecting unit 31[*m*] according to the second exemplary embodiment. As illustrated as an example in FIG. 7, similar to the first exemplary embodiment, the flow path structure 311 of the liquid ejecting unit 31[*m*] according to the second exemplary embodiment includes the first portion P1 and the second portion P2. The first portion P1 according to the second exemplary embodiment includes a valve mechanism 95*a* and a valve mechanism 95*b*. Configurations of the valve mechanism 95*a* and the valve mechanism 95*b* are similar to that of the valve mechanism 95 of the first exemplary embodiment. The valve mechanism 95*a* supplies the ink to the first ejecting portion 10*a*, and the valve mechanism 95*b* supplies the ink to the second ejecting portion 10*b*. The valve mechanism 95*a* and the valve mechanism 95*b* have a horizontally inverted relationship in FIG. 7. In other words, a first liquid chamber 511*a* corresponding to the valve mechanism 95*a* is formed on the first face F1 of the base portion 51, and a first liquid chamber 511*b* corresponding to the valve mechanism 95*b* is formed on the second face F2 of the base portion 51. Furthermore, a movable film 53*a* of the valve mechanism 95*a* is provided on the first face F1 of the base portion 51, and a movable film 53*b* of the valve mechanism 95*b* is provided on the second face F2 of the base portions 51. On the movable film 53*a*, a heating portion 313*a* is provided on a surface of the movable film 53*b* and on a side of the movable film 53*b* opposite the first liquid chamber 511*a*, a heating portion 313*b* is provided on a surface on the side opposite the first liquid chamber 511*b*.

The second portion P2 of the second exemplary embodiment individually includes a filter portion 97*a* into which the ink that has passed through the valve mechanism 95*a* flows, and a filter portion 97*b* into which the ink that has passed through the valve mechanism 95*b* flows. Note that in FIG. 7, for convenience sake, a single filter portion 97 is illustrated. The ink that has passed through the filter portion 97*a* is supplied to the first ejecting portion 10*a*, and the ink that has passed through the filter portion 97*b* is supplied to the second ejecting portion 10*b*. An effect similar to the first exemplary embodiment can be provided in the second exemplary embodiment as well.

Third Exemplary Embodiment

Figure 8:
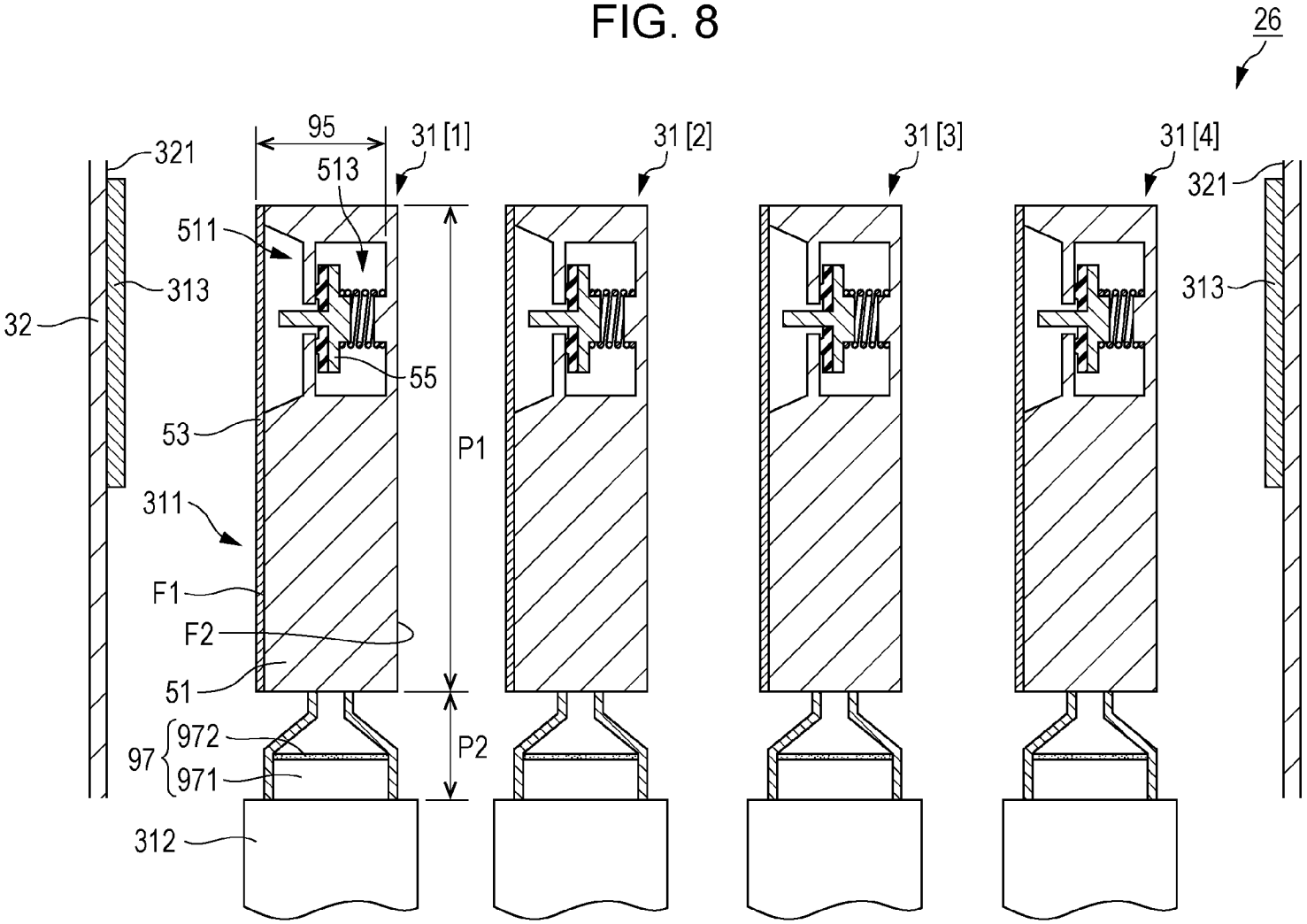
FIG. 8 is a cross-sectional view of a liquid ejecting portion according to a third exemplary embodiment.

FIG. 8 is a cross-sectional view of the liquid ejecting portion 26 according to a third exemplary embodiment. In the first exemplary embodiment, an example of a configuration in which the heating portion 313 is provided on the flow path structure 311 has been given; however, in the third exemplary embodiment, an example of a configuration in which the heating portions 313 are provided in the housing body 32 that houses the flow path structures 311 will be given.

As illustrated as an example in FIG. 8, the heating portions 313 are provided, among inner wall surfaces 321 of the housing body 32, in areas corresponding to the first liquid chambers 511 of the flow path structures 311. Specifically, the heating portions 313 are provided, among the inner wall surfaces 321, at positions where the ink inside the first liquid chambers 511 can be heated. For example, the heating portions 313 are provided at positions, in the inner wall surfaces 321, opposing the first liquid chambers 511 or at positions, in the inner wall surfaces 321, opposing the second liquid chambers 513. Note that the position where each heating portions 313 is provided can be any position that allows the ink inside the first liquid chambers 511 to be heated.

In the third exemplary embodiment, since the heating portions 313 are provided in the housing body 32 that houses the flow path structure 311, the ink is heated before being supplied to the minute flow paths inside the liquid ejecting heads 312. Accordingly, when compared with the comparative example in a manner similar to the first exemplary embodiment, the temperature of the ink ejected from the liquid ejecting head 312 can be maintained in an appropriate manner. Furthermore, compared with a configuration in which the heating portion 313 is provided in the flow path structure 311, a reduction in the size of the flow path structure 311 can be achieved in the third exemplary embodiment.

Modifications

Each of the exemplary embodiments described above as examples can be modified in various ways. Specific modification modes that can be applied to the exemplary embodiments described above will be described below as examples. Two or more optionally selected modes from the examples below can be merged as appropriate as long as they do not contradict each other.

1. In the configurations described above, a configuration in which the flow path structure 311 includes the valve mechanism 95 and the filter portion 97 has been described as an example; however, the configuration of the flow path structure 311 is not limited to the above example. For example, a configuration in which the flow path structure 311 includes either one of the valve mechanism 95 and the filter portion 97 can be adopted. Furthermore, the flow path structure 311 may be a flow path substrate in which various flow paths that supply the ink in the liquid reservoir 72 to each liquid ejecting unit 31[*m*] are formed. In such a configuration, the flow path structure 311 is provided with the heating portion 313 that heats the ink inside the flow paths. As understood from the above description, a structure to which the liquid ejecting head 312 is coupled and in which a space or a flow path into which ink from the liquid reservoir 72 flows is formed is comprehensively expressed as the flow path structure 311. Note that the liquid ejecting head 312 and the flow path structure 311 may be directly connected to each other, or the liquid ejecting head 312 and the flow path structure 311 may be indirectly connected to each other through another structure.

2. In the first and second exemplary embodiments, a configuration in which the heating portion 313 is provided in the first portion P1 in the flow path structure 311 has been described as an example; however, the position where the heating portion 313 is provided is not limited to the above example. For example, the heating portion 313 may be provided in the second portion P2 that includes the filter portion 97. The heating portion 313 heats the ink inside the filter chamber 971. Since the ink temporarily stagnates inside the filter portion 97, with a configuration in which the heating portion 313 is provided in the second portion P2 that includes the filter portion 97, the temperature of the ink can be maintained in an appropriate manner inside the filter portion. The filter chamber 971 is an example of a "heating liquid chamber". The heating portion 313 is provided at an optional position in the flow path structure 311 in which the heating liquid chamber is formed.

3. In the first and second exemplary embodiments, a configuration in which the ink inside the first liquid chamber 511 is heated by providing the heating portion 313 on the surface of the movable film 53 has been described as an example; however, the position where the heating portion 313 is provided is not limited to the movable film 53. The position where the heating portion 313 is provided may be any area on the surface of the flow path structure 311 that is near the first liquid chamber 511. The heating portion 313 may be provided on a surface of the base portion 51 in the flow path structure 311. The temperature of the ink inside the first liquid chamber 511 can be maintained appropriately with a configuration in which the heating portion 313 is provided on the surface of the flow path structure 311 and in an area near the first liquid chamber 511.

Furthermore, the ink inside the second liquid chamber 513 may be heated by providing the heating portion 313 on the surface of the base portion 51 and in an area near the second liquid chamber 513. In the above configuration, the second liquid chamber 513 is an example of the "heating liquid chamber". As understood from the above description, the space in which the ink heated by the heating portion 313 is stored is comprehensively expressed as the "heating liquid chamber". Note that the heating portion 313 may be provided inside the heating liquid chamber.

Figure 9:
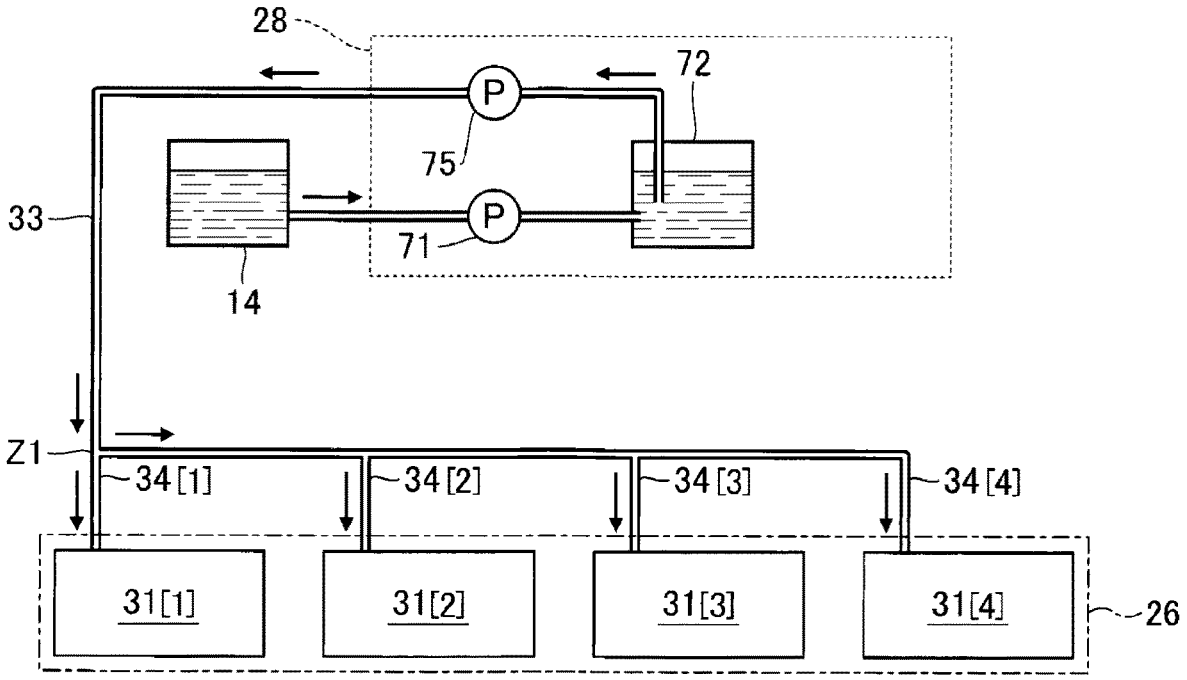
FIG. 9 is a schematic diagram illustrating, as an example, configurations of a liquid ejecting portion and a flow path mechanism according to a modification.
Figure 10:
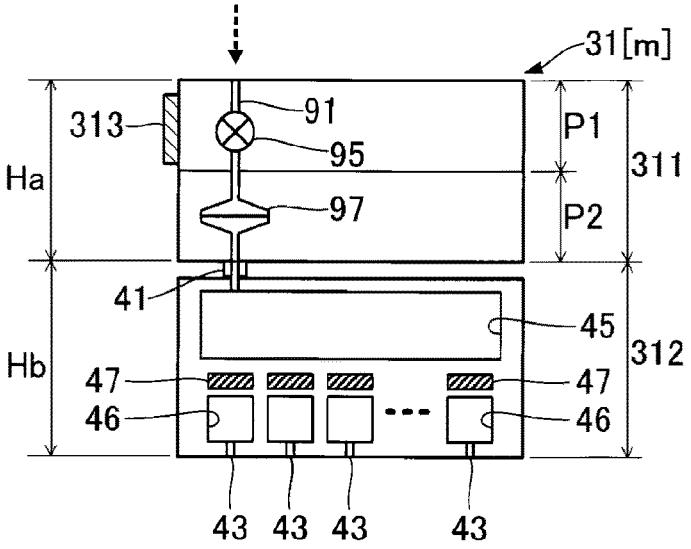
FIG. 10 is a schematic diagram illustrating, as an example, a configuration of a liquid ejecting unit according to a modification.

4. As illustrated in FIG. 2, in the configurations described above, a configuration in which the liquid ejecting apparatus 100 includes the circulation mechanism that circulates the ink has been described as an example; however, the circulation mechanism may be omitted. FIG. 9 is a diagram illustrating, as an example, configurations of the liquid ejecting portion 26 and the flow path mechanism 28 in which the circulation mechanism has been omitted, and FIG. 10 is a block diagram illustrating, as an example, another configuration of the liquid ejecting unit 31[*m*] in which the circulation mechanism has been omitted. As it can be understood by comparing FIG. 9 and FIG. 2 with each other, the second individual flow paths 35[*m*] and the second common flow path 36 for having the ink discharged from the liquid ejecting portion 26 flow into the liquid reservoir 72 are omitted in FIG. 9. As it can be understood by comparing FIG. 10 and FIG. 3 with each other, the discharge port 42 and the discharge flow path 92 are omitted in FIG. 10. As illustrated in FIGS. 9 and 10, the configurations described above are applied even in the configuration in which the circulation mechanism has been omitted.

Figure 11:
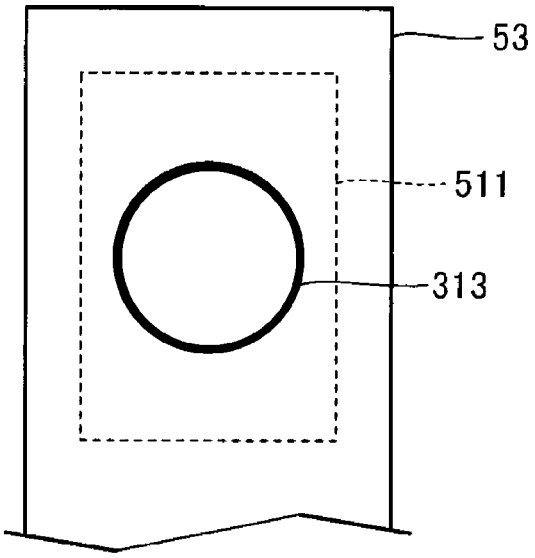
FIG. 11 is a plan view of a heating portion according to a modification.
Figure 12:
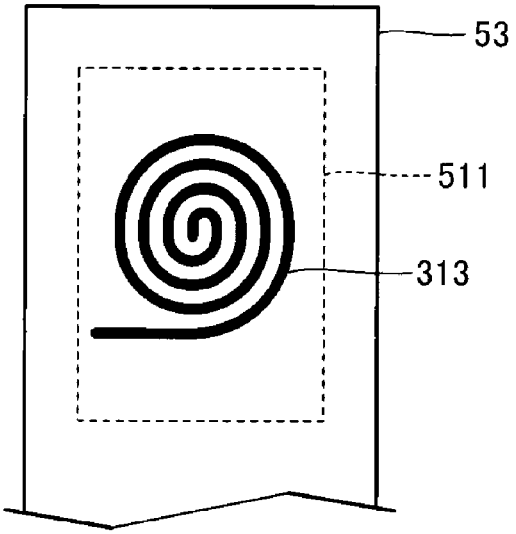
FIG. 12 is a plan view of a heating portion according to a modification.

5. In the configurations described above, the shape of the heating portion 313 is optional. For example, the heating portion 313 having shapes illustrated as examples in FIGS. 11 and 12 can be adopted. FIGS. 11 and 12 are plan views of the heating portion 313 of the liquid ejecting unit 31[*m*] in FIG. 4 viewed from a side opposite the valve body 55. A planar shape of the heating portion 313 illustrated in FIG. 11 is a circular shape. Accordingly, compared with, for example, a configuration in which the heating portion 313 has a rectangular shape, flexure of the movable film 53 when the movable film 53 is moved can be uniform.

Furthermore, a planar shape of the heating portion 313 illustrated in FIG. 12 is a spiral shape. With such a configuration, the contact area per unit area between the heating portion 313 and the movable film 53 becomes small. Accordingly, in addition to uniformizing the flexure as in FIG. 11, hindering of the movement of the movable film 53 due to the stiffness of the heating portion 313 can be reduced.

Figure 13:
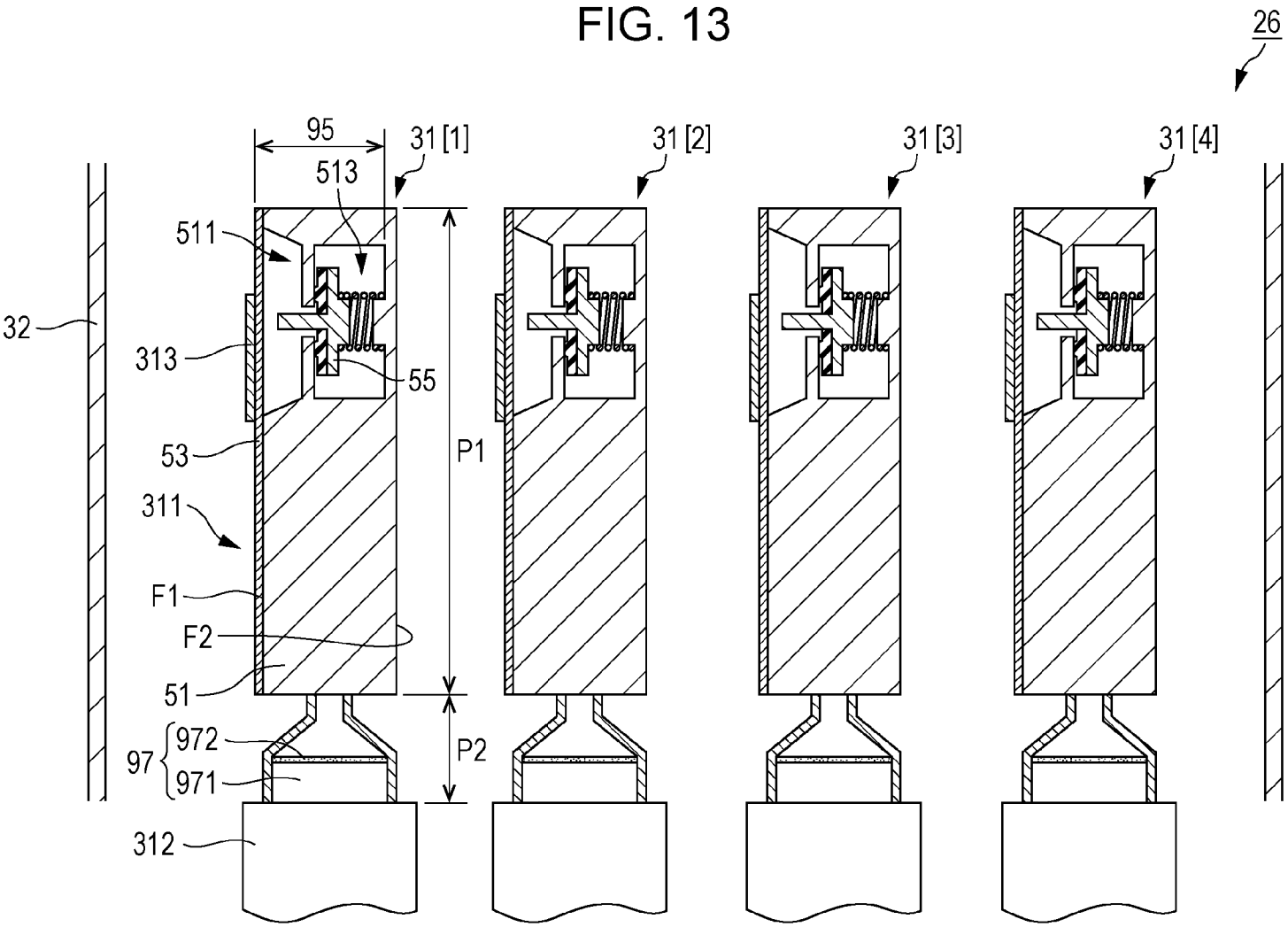
FIG. 13 is a cross-sectional view of a liquid ejecting portion according to a modification.

6. In the configurations described above, the position on the surface of the movable film 53 where the heating portion 313 is provided is optional. However, as illustrated in FIG. 13, a configuration in which the heating portion 313 is provided on the surface of the movable film 53 in an area corresponding to a portion below the center portion of the first liquid chamber 511 in the vertical direction is desirable. Specifically, when viewed in a first direction, which is orthogonal to the vertical direction, the heating portion 313 overlaps the first liquid chamber 511, and the center of gravity of the heating portion 313 when viewed in the first direction is positioned vertically below the center of gravity of the first liquid chamber 511 when viewed in the first direction. Since the ink, due to gravity, accumulates on the lower side in the vertical direction, the ink can be heated in a desirable manner by providing the heating portion 313 in the area corresponding to a portion below the first liquid chamber 511.

7. In the configurations described above, the flow path mechanism 28 may include a heating mechanism that heats the ink inside the liquid reservoir 72.

8. In the configurations described above, while a serial liquid ejecting apparatus that reciprocates the transport body 242 in which the liquid ejecting portion 26 is mounted has been described as an example, a line liquid ejecting apparatus in which a plurality of nozzles 43 are distributed across the entire width of the medium 12 can also be applied to the present disclosure.

9. The liquid ejecting apparatuses described as examples in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting unit comprising:

a flow path structure into which a liquid flow from a liquid reservoir that temporarily stores the liquid;

a liquid ejecting head coupled to the flow path structure and including a nozzle for ejecting the liquid supplied from the flow path structure and a drive element for causing the liquid to be ejected from the nozzle; and a heating portion heating the liquid inside the flow path structure, wherein the heating portion is different from and positioned at a different location than the drive element.

2. The liquid ejecting unit according to claim 1 wherein the heating portion has a thin film shape.

3. The liquid ejecting unit according to claim 1 wherein the heating portion is provided on a surface of the flow path structure.

4. The liquid ejecting unit according to claim 1, further comprising:

a housing body housing the flow path structure, wherein the heating portion is provided in the housing body.

5. The liquid ejecting unit according to claim 1, wherein the flow path structure includes a first portion including, a heating liquid chamber into which the liquid flow from the liquid reservoir, and a valve mechanism that supplies the liquid to the liquid ejecting head in accordance with a pressure in the heating liquid chamber, and the heating portion is provided in the first portion.

6. The liquid ejecting unit according to claim 5, wherein the valve mechanism includes a movable film that constitutes a wall surface of the heating liquid chamber and that moves based on a change in pressure in the heating liquid chamber, and the heating portion is provided on a surface of the movable film that faces away from the heating liquid chamber.

7. The liquid ejecting unit according to claim 1, wherein the flow path structure includes a second portion including a heating liquid chamber into which the liquid flow from the liquid reservoir, and a filter that is provided in the heating liquid chamber, the liquid supplied to the liquid ejecting head passing through the filter, and the heating portion is provided in the second portion.

8. The liquid ejecting unit according to claim 1, wherein the liquid ejecting head includes a common liquid chamber that stores the liquid supplied from the flow path structure, and a pressure chamber that ejects, through the nozzle, the liquid supplied from the common liquid chamber, and a volume of the heating liquid chamber is larger than a volume of the common liquid chamber.

9. The liquid ejecting unit according to claim 1, wherein a height of the flow path structure and a height of the liquid ejecting head are substantially equivalent to each other.

10. The liquid ejecting unit according to claim 1, wherein the heating portion has a circular shape.

11. The liquid ejecting unit according to claim 1, wherein the heating portion has a spiral shape.

12. The liquid ejecting unit according to claim 1, wherein the flow path structure includes a heating liquid chamber into which the liquid flow from the liquid reservoir, and when viewed in a first direction orthogonal to a vertical direction, the heating portion overlaps the heating liquid chamber, and a center of gravity of the heating portion when viewed in the first direction is, in the vertical direction, positioned below a center of gravity of the heating liquid chamber when viewed in the first direction.

13. A liquid ejecting apparatus comprising the liquid ejecting unit according to claim 1.

14. The liquid ejecting apparatus according to claim 13, wherein the liquid ejecting head includes, a common liquid chamber that stores the liquid supplied from the flow path structure, and a pressure chamber that ejects, through the nozzle, the liquid supplied from the common liquid chamber, and the liquid ejecting apparatus further includes a circulation mechanism that recirculates the ink that has passed through the common liquid chamber or the pressure chamber to the common liquid chamber.

15. A liquid ejecting unit comprising:

a flow path structure into which a liquid flow from a liquid reservoir that temporarily stores the liquid;

a liquid ejecting head coupled to the flow path structure and including a nozzle for ejecting the liquid supplied from the flow path structure; and a heating portion heating the liquid inside the flow path structure, wherein the flow path structure includes a first portion including, a heating liquid chamber into which the liquid flow from the liquid reservoir, and a valve mechanism that supplies the liquid to the liquid ejecting head in accordance with a pressure in the heating liquid chamber, the heating portion is provided in the first portion, the valve mechanism includes a movable film that constitutes a wall surface of the heating liquid chamber and that moves based on a change in pressure in the heating liquid chamber, and the heating portion is provided on a surface of the movable film that faces away from the heating liquid chamber.

16. A liquid ejecting unit comprising:

a flow path structure into which a liquid flow from a liquid reservoir that temporarily stores the liquid;

a liquid ejecting head coupled to the flow path structure and including a nozzle for ejecting the liquid supplied from the flow path structure; and a heating portion heating the liquid inside the flow path structure, wherein the flow path structure includes a heating liquid chamber into which the liquid flow from the liquid reservoir, and when viewed in a first direction orthogonal to a vertical direction, the heating portion overlaps the heating liquid chamber, and a center of gravity of the heating portion when viewed in the first direction is, in the vertical direction, positioned below a center of gravity of the heating liquid chamber when viewed in the first direction.

* * * * *